United States Patent [19]

Martino

[11] Patent Number: 4,902,541

[45] Date of Patent: Feb. 20, 1990

[54] GOLF RANGE MAT

[76] Inventor: Louis D. Martino, 3 Oak Hill La., Rome, Ga. 30161

[21] Appl. No.: 272,512

[22] Filed: Nov. 17, 1988

[51] Int. Cl.[4] ..... A63B 69/36

[52] U.S. Cl. ..... 428/17; 156/72; 427/389.9; 427/394; 427/412; 428/95; 428/137

[58] Field of Search ..... 428/17, 95, 137; 156/72; 427/389.9, 394, 412; 273/183 A, 195 R

[56] References Cited

U.S. PATENT DOCUMENTS 4,268,551 5/1981 Moore ..... 428/17

4,617,218 10/1986 Cadenhead ..... 428/17

*Primary Examiner*—Marion C. McCamish

*Attorney, Agent, or Firm*—James B. Middleton

[57] ABSTRACT

Artificial athletic turf has a simulated grass surface provided by tufting strips into a backing fabric. The tufts are held in place by a precoat of polyurethane, and a reinforcing sheet is embedded within the precoat to provide tear resistance. A formed polyurethane is placed on the precoat, and one or more reinforcing sheet are also embedded within the foamed polyurethane. The strips are hydrophobic plastic with strength to prevent damage, and the coatings are polyurethane reinforced for tear resistance, which also yields a resilience as needed for an athletic mat. A hole can be cut into the mat, and the hole reinforced with a sleeve, to receive a tee for use as a golf mat.

9 Claims, 1 Drawing Sheet

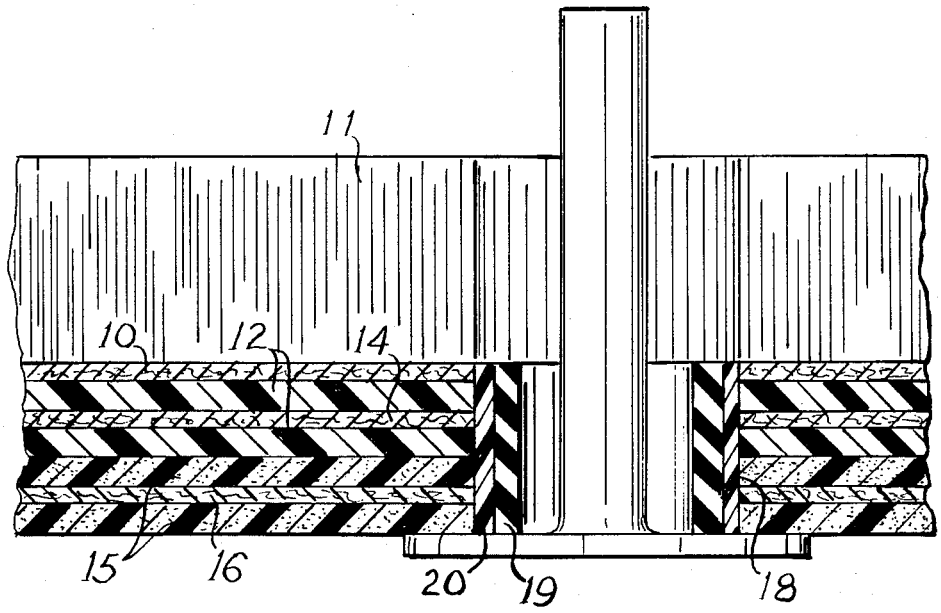
11
10
12
14
15
16
20
19
18

GOLF RANGE MAT

INFORMATION DISCLOSURE STATEMENT

There are numerous prior art athletic mats for use in various sports. These athletic mats commonly comprise a rubber base, sometimes having a pile surface created by tufting or the like. While some of these mats have met with reasonable success, there are numerous areas in which either the mats have not been widely utilized or the mats are used but must be very frequently replaced.

In the area of mats for golf there are numerous prior designs, but none has been completely successful. The most common mat for use in golf is a simple rubber mat, sometimes having a pile surface and sometimes having a textured rubber surface. There have also been attempts at utilizing polyurethane to provide a golf mat, the polyurethane usually being applied to the back of a tufted carpet material. Such arrangements have not been satisfactory in that the polyurethane pad quickly delaminates from the tufted carpet and in any event the entire mat rips and is literally torn to pieces.

One of the most demanding athletic mats is the mat used on a golf driving range. It is of course desirable to utilize a grass-like surface to simulate the usual grass golf course. Also, the cushioning is highly important because a golfer is swinging a long, relatively heavy, club with great force. If the club head hits the "ground", and the ground has absolutely no give, there can be damage to club, and to the golfer. On a practice range, it must be expected that the surface will be engaged directly by the club head with great frequency; thus, it is highly important that the mat for a golf range provide the desired cushioning to simulate a natural grassy area of the ground, and also that the mat stand up to this severe abuse.

SUMMARY OF THE INVENTION

This invention relates generally to athletic mats, and is more particularly concerned with a golf range mat having a simulated grass surface, sufficient padding to simulate normal earth, and sufficient durability to be practicable.

The present invention provides a golf mat including a backing fabric tufted with conventional artificial grass. This fabric has a back coating of polyurethane, the polyurethane being poured onto the tufted backing to encapsulate the tufts. A fibrous sheet is embedded in the polyurethane to give additional strength to the coating. Before the polyurethane coating is fully cured, a second, frothed, polyurethane mixture is placed on the backing to provide a foamed padding. A fibrous reinforcing sheet may be embedded in the foamed polyurethane to provide tear resistance.

In one embodiment of the invention, the mat of the present invention is provided with a hole to receive a driving range tee; and, a reinforcing sleeve is bonded to the inside of the hole to prevent tears in this normally vulnerable spot.

BRIEF DESCRIPTION OF THE DRAWING

These and other features and advantages of the present invention will become apparent from consideration of the following specification, when taken in conjunction with the accompanying drawing in which:

The single FIGURE is an enlarged, cross-sectional view taken through a golf range mat made in accordance with the invention.

DETAILED DESCRIPTION OF THE EMBODIMENT

Referring now more particularly to the drawing, and to that embodiment of the invention here presented by way of illustration, the mat includes a conventional carpet backing designated at 10 having synthetic grass 11 tufted therein. Those skilled in the art will understand that the backing 10 may be any of numerous backing materials, one of the more common being a woven polypropylene fabric. This fabric or numerous other conventional backing fabrics can be used as desired.

The simulated grass 11 is most commonly made of thin sheets of polypropylene that are longitudinally slit to provide strips simulating blades of grass. Again, polypropylene works quite well, but other materials such as nylon and polyester are also useful. One must simply remember that the material is to be used outdoors so that it must normally be hydrophobic, and the material will receive large shear forces so that the material must be rather tough.

After a backing material has been tufted, it is conventional to coat the back of the material with an adhesive substance to lock in the tufts. Prior art efforts at making golf mats have included the use of a polyurethane to provide a cushion and to lock in the tufts, but these past efforts have met with little success. One of the primary difficulties is that polyurethane, and most of the other adhesives utilized, are polar substances while polypropylene is a non-polar substance; thus, there is simply no specific adhesion between the adhesive and the polypropylene. Additionally, it has been found that must of the problem in golf mats is not due to the normal delamination caused by lack of adhesion, deterioration through hydrolysis and the like, but is caused by literally tearing the mat due to the high shear forces. When the mat is so torn, the polyurethane may or may not be forcibly pulled from the tufted carpet.

The present invention resolves the above mentioned difficulties first by pouring a liquid polyurethane mix onto the back of the tufted carpet, which is to say onto the backing 10. The viscosity of the polyurethane mix is such that the mixture will somewhat flow through the backing 10 so the tufts of grass 11 are totally encapsulated in the vicinity of the backing 10. While there may be no specific adhesion between the polyurethane and the polypropylene, the fact that the individual tufts are completely surrounded with the polyurethane provides an excellent lock for the tufts.

In the drawing, the polyurethane coat is designated at 12; and, it will be seen that there is a fibrous sheet 14 between two layers designated at 12. It will be understood that the drawing is rather schematic, and the fibrous sheet 14 represents a reinforcing sheet completely embedded in the polyurethane 12.

If the sheet 14 is not sufficiently permeable, one might place a first coating of polyurethane against the backing 10, then place the sheet 14, and lay another coat of polyurethane 12. On the other hand, with some knit or open weave sheets 14 that are sufficiently permeable, the sheet 14 may be placed into the polyurethane mixture and the sheet 14 will become embedded in the mixture 12. Additionally, multiple reinforcing sheets and polyurethane precoats may be used. Again, one or more reinforcing sheets may be used, comprising woven or nonwoven fabrics, woven paper yarn or nonwoven paper, and/or needle felts with or without reinforcing scrims.

Polyurethane mixtures are most often catalytically cured, and it is contemplated that the mixture 12 will be held and allowed to cure in place.

It is well known that, in conventional carpeting, one is normally concerned that the polyurethane coating will bleed through the backing 10 and be visible from the face side of the carpet. In the present invention, some such spike through will be desirable in order to encapsulate the tufts fully. Nevertheless, extremes must still be avoided since the surface should simulate grass as nearly as possible.

Before the polyurethane coating 12 has fully cured, a second coating designated at 15 is applied. As before, the coating 15 is shown in two layers separated by a fibrous material 16.

It will be noted that the coating 15 is indicated as foamed. The coating 15 is also a polyurethane, but the coating 15 is foamed, or frothed, to provide the desired cushioning effect.

Those skilled in the art will understand that polyurethane mixtures are foamed in several different ways. The most commonly used technique for carpet padding and the like is to add water to the polyurethane mixture, the water reacting with the isocyanate to produce gas for blowing the mixture. Flourinated hydrocarbons are also used fairly frequently, the heat of reaction of the polyurethane causing the flourinated hydrocarbon to boil and yield the gas for blowing the material. A third technique is to froth the material mechanically to provide a sufficient inclusion of air to yield the foam density desired. While any of these techniques might be used, it is contemplated that the mechanical frothing technique will be used in view of the relatively high density desired. Whereas a conventional carpet backing might have a density in the vicinity of two to three pounds per cubic foot, the padding for use in the present invention should have a density in the general range of 8 to 38 pounds per cubic foot.

After the polyurethane material has been frothed, it will be laid on the coating 12. As before, the reinforcing sheet 16 might be placed between two coatings of polyurethane material 15, or it might be placed into the one coating while the coating is substantially fluid.

As has been mentioned above, the polyurethane coatings 12 and 15 are generally conventional polyurethanes, and those skilled in the art will readily devise numerous workable formulations. By way of example, the following formulation has been successfully used as the coating 12:

| Item | Parts by Weight |
|---|---|
| Polypropylene Glycol (average molecular weight 3,000–5,000) | 80.0 |
| Reinforcing Polyol | 20.0 |
| Catalyst | 0.5 |
| Pigment | 2.0 |
| Mineral Filler (clay, aluminum trihydrate etc.) | 50.0 |
| Moisture Scavanger | 2.0 |
| Diphenyl Methane Di-isocyanate | 34.7 |

The foamed polyurethane 15 has been made with exactly the same formulation, but with the addition of 3.0 parts of a silicone surfactant to facilitate the frothing of the material.

With the above description in mind, it should be understood that the reinforcing sheets 14 and 15 can take almost any form, including knit fabrics, non-woven fabrics, woven fabrics of either a tight weave or a very loose weave or the like. The reinforcing sheets may be polyester, fiberglass, nylon or other materials with reasonably high strength, and including paper sheets. Thus, it must be realized that the reinforcing sheets 14 and 16 are not for the purpose of lending dimensional stability to the mat, but to provide tear resistance. As was mentioned above, it has been found that the primary problem in destruction of the golf range mats is the tearing of the mat. The tearing may appear to be delamination of a cushion from a tufted fabric, but the tearing is the initial problem, and the delamination tends to be more of a symptom. Thus, by providing sufficient tear resistance the mat will have greater durability, and delamination is no longer a problem.

The present invention further provides two urethane coatings that are poured on in liquid form and cured in place. As is well known to those skilled in the art, if the second coating 15 is placed on the first coating 12 before the coating 12 is fully cured, there will be an intimate bond between the two coatings so that delamination is virtually impossible. It has been mentioned that the polyurethane precoat 12 will not adhere to the polypropylene grass 11 or the polypropylene woven tufting primary backing 10. The polypropylene grass and the polypropylene primary backing are encapsulated by the polyurethane sufficiently that the entire mat will stay together.

Another common problem is golf range mats is that the mats tend to tear in the vicinity of the golf tee. It has been found that, with repeated beating by the golf clubs, the tee is forced into the mat, or the mat is forced into the tee. In either case, the tee is jammed against a raw edge of a mat where the mat is particularly vunerable. This frequently causes early breakdown of the mat. Mats will similarly fail at the location for iron shots, i.e. without tee holes.

In the present invention, it is contemplated that a mat will be made as described above, and a hole 18 will be subsequently cut through the mat. First, it will be realized that the mat of the present invention has the two reinforcing sheets 14 and 16, and these sheets are completely encapsulated within polyurethane. As a result, even the cut edge will have reasonably good strength and resistance to tear. To enhance the strength further, it is contemplated that a sleeve 19 will be place into the hole 18. To carry out the intent of the present invention, an adhesive layer 20 will be placed into the hole 18, and the sleeve 19 will then be put into place so that the sleeve 19 will be held by the adhesive 20. Furthermore, it is contemplated that the adhesive 20 will be a polyurethane formulation similar to the material 12. In this case, the polyurethane 20 will completely coat and encapsulate the cut edges of the reinforcing sheets 14 and 16 which will repair any damage done by cutting the hole 18. any gaps and the like will be filled, and the additional strength of the reinforcing sleeve 19 will be provided.

It will therefore be seen that the present invention provides an athletic mat having a grass-like surface that is well locked into the backing through the encapsulation in the polyurethane. The polyurethane coating provides toughness along with some resilience, and the foamed polyurethane coating provides the desired resilience. The reinforcing fabrics render the mat highly tear resistant which resolves most of the difficulties in rapid destruction by being hit with golf clubs or the like.

While the grass surface 11 might be polypropylene or nylon as is conventional, it is also contemplated that other materials can be used, either alone or in combination. For example, a polyester yarn run parallel with a polypropylene yarn, and the pair texturized, will provide a yarn of greater bulk as well as a more carpetlike appearance. Also, while the invention has been described primarily as a mat for a golf driving range, it will be readily understood that the invention provides a mat that simulates a grass covered earth field, and can therefore be used in virtually any sport or the like where grassy turf is desired. The toughness and durability of the mat of the present invention that tenders it desirable for withstanding the forces of golf clubs can also withstand the forces of football cleats and the like.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. Athletic turf comprising a simulated grass surface and padding to simulate earth, said turf including a backing fabric, tufts in said backing fabric to simulate grass, a first coating on said backing fabric for locking said tufts in said backing fabric, a second coating formed on said first coating and adhered thereto, and a plurality of fibrous sheets within said first coating and said second coating, said plurality of fibrous sheets extending parallel to said backing fabric, said first coating comprising a cured in place polyurethane, one of said plurality of fibrous sheets being embedded within said first coating, said second coating comprising a foamed polyurethane adhered to said first coating, and another of said plurality of fibrous sheets being embedded within said second coating, said tufts in said backing fabric consisting of strips of material simulating grass, said first coating encapsulating said tufts to hold said tufts to said backing fabric.

2. Athletic turf as claimed in claim 1, said athletic turf comprising a mat for a golf range, said tufts including sufficient length for providing said simulated grass surface on the face of said backing fabric, said mat defining a hole therethrough for receiving a driving range tee, the arrangement being such that said fibrous sheets strengthen the edges of said hole to prevent tearing.

3. Athletic turf as claimed in claim 2, and including a sleeve received within said hole for further reinforcing said hole, and an adhesive between said sleeve and said mat for retaining said sleeve within said hole.

4. A mat for golf driving range, said mat including a backing fabric, strips of material tufted into said backing fabric for simulating grass, a first coating on said backing fabric for locking the tufts in said backing fabric and securing said strips of material in said backing fabric, a fibrous sheet embedded within said first coating, said fibrous sheet being parallel to said backing fabric, and a second coating fixed to said first coating, said second coating comprising a foamed elastomeric material for providing a cushion for said mat.

5. A mat as claimed in claim 4, said first coating comprising a polyurethane, said second coat comprising a foamed polyurethane, and further including a second fibrous sheet embedded within said second coat, said second fibrous sheet being parallel to said backing fabric.

6. A mat as claimed in claim 5, said strips of material comprising a material selected from the group consisting of polypropylene, nylon, and polyester, and mixtures thereof.

7. A mat as claimed in claim 4, said mat defining a hole therethrough for receiving a tee, a sleeve within said hole, and adhesive between said sleeve and said hole for securing said sleeve within said hole.

8. A method for making an athletic turf comprising a simulated grass surface and padding to simulate earth, said method including the steps of tufting a backing fabric with strips to simulate grass, pouring a polyurethane mix onto the back of said backing fabric and allowing said polyurethane mix to encapsulate said strips tufted into said backing fabric and to react, preparing a second polyurethane mix and frothing said second polyurethane mix, pouring said second polyurethane onto the partially cured polyurethane mix and allowing both said polyurethanes to cure, and including the step of placing a fibrous sheet in at least one of said polyurethane mixes prior to the step of allowing said polyurethanes to cure.

9. A method as claimed in claim 8, wherein the said step of placing a fibrous sheet in a least one of said polyurethane mixed comprises the steps of placing a first fibrous sheet in said polyurethane mix and allowing said sheet to become immersed in said mix, and placing a second fibrous sheet in said second polyurethane mix and allowing said second sheet to become immersed in said second mix.

* * * * *